United States Patent [19]

Deutsch

[11] 4,144,789

[45] Mar. 20, 1979

[54] AMPLITUDE GENERATOR FOR AN ELECTRONIC ORGAN

[75] Inventor: Ralph Deutsch, Sherman Oaks, Calif.

[73] Assignee: Kawai Musical Instrument Mfg. Co. Ltd., Hamamatsu, Japan

[21] Appl. No.: 803,447

[22] Filed: Jun. 6, 1977

[51] Int. Cl.[2] ..... G10H 1/02

[52] U.S. Cl. ..... 84/1.24; 84/1.27

[58] Field of Search ..... 84/1.01, 1.03, 1.12, 84/1.13, 1.24, 1.21, 1.27; 364/750, 757; 340/347 DD; 235/92 CM

[56] References Cited

U.S. PATENT DOCUMENTS

| | | | |
|---|---|---|---|
| 3,594,560 | 7/1971 | Stanley | 235/154 |
| 3,763,364 | 10/1973 | Deutsch et al. | 235/152 |
| 3,863,248 | 1/1975 | Deschenes et al. | 340/347 DD |
| 3,952,627 | 4/1976 | Deutsch | 84/1.24 |
| 4,031,377 | 6/1977 | Deutsch et al. | 235/164 |

OTHER PUBLICATIONS

H. Kaneko, "A Uniform Formulation of Segment Companding Lans & Synthesis of Codecs & Digital Compandors.", The Bell System Technical Journal, Sep. 1970, pp. 1555–1589.

*Primary Examiner*—Robert K. Schaefer
*Assistant Examiner*—Vit W. Miska
*Attorney, Agent, or Firm*—Christie, Parker & Hale

[57] ABSTRACT

An amplitude curve generator for use with an electronic organ or the like to control the musical shape of an audible tone. The generator utilizes a simple binary down counter driven from a clock source to produce a sequence of decreasing binary numbers that approximate the relative amplitudes of equally spaced points along an exponential decay curve. The count condition of the least significant bits of the counter correspond to the mantissa of number expressed in binary floating point notation. The most significant bits represent the power. The bits of the mantissa are transferred to a parallel shift circuit and shifted a number of times determined by the bits of the power to convert the number in the counter to fixed point notation. The output of the shift circuit is used to control the envelope amplitude of a musical tone. The output may be subtracted from one (2's complement) to produce a set of values that correspond to an exponential attack curve rather than a decay curve. The counter can be interrupted at any point for some period of time or counted at a different frequency to tailor the wave shape to a particular attack, decay, sustain and release pattern.

10 Claims, 2 Drawing Figures

AMPLITUDE GENERATOR FOR AN ELECTRONIC ORGAN

FIELD OF THE INVENTION

This invention relates to digital electronic organs and more particularly to a digital envelope curve generator.

BACKGROUND OF THE INVENTION

The sound of a musical tone generated by a musical instrument is not only determined by the spectral content of the wave shape but also the changes in the amplitude of the envelope of the wave shape as a function of time. A musical tone generally may be subdivided into four parts, commonly referred to as the attack, the decay, and sustain, and the release parts. The relative times of each of these parts from the time the tone is initiated until the tone is terminated greatly influence the characteristic sound of the tone being generated. In an electronic organ, where the key operates merely as a switch, the attack, decay and release times may be extremely short. The sustain time of course is a function of how long the key is depressed. However, various arrangements have been provided for automatically controlling the attack, decay and release times to achieve different tonal effects. The circuits for controlling the relative time of these four parts of the wave shape envelope are commonly referred to as ADSR generators.

A number of different types of ADSR generators have been heretofore proposed, both analog and digital. Analog generators typically employ resistance-capacitor networks. However, such analog generators are cumbersome and expensive because of the large values of capacitors required to obtain long release times. Furthermore, such circuits are difficult to design so as to provide relatively consistent characteristics for each note of the keyboard. For this reason, digital type ADSR generators have been developed for electronic organs even where the musical tones are generated by analog signals. One such ADSR generator is described in U.S. Pat. No. 3,610,805 in which the wave shape of the envelope is stored as binary data in a read only memory. This envelope data is read out on demand and is timed from the periods of the musical wave shape or from an independent clock. In the case of a digital organ, this digital information can be combined with digital data controlling the wave shape of the musical tone or the data can be converted to an analog voltage by a digital-to-analog converter and used to modulate the peak amplitude of the tone generator. U.S. Pat. No. 3,982,461 shows a similar digital ADSR generator in which the stored amplitude data is used directly to modify the digital data samples of the tone wave form. In copending application Ser. No. 652,217, filed June 26, 1976, now issued as U.S. Pat. No. 4,079,650 and entitled "ADSR Envelope Generators", in the name of Ralph Deutsch and Leslie J. Deutsch, a digital ADSR generator is described which calculates the digital values defining the envelope of the ADSR curve by a recursive routine which is modified for each of four different portions of the curve.

SUMMARY OF THE INVENTION

The present invention is directed to a digital type ADSR generator for use in digital organs, and more specifically digital organs of the type having a digital tone synthesizer such as described in copending application Ser. No. 603,776, filed Aug. 11, 1975, now issued as U.S. Pat. No. 4,085,644 in the names of Ralph Deutsch and Leslie Deutsch. The ADSR generator of the present invention utilizes the logarithmic character of binary floating point numbers to approximate exponential curves. These curves are combined to form the attach, decay and release portions of the output wave form of the ADSR generator. It is known that any number can be written approximately as a binary floating point number in the form $1.a_1a_2a_3x2^{\alpha}$ where $a_1$, $a_2$, $a_3$ may be either of the two binary values 0 or 1 and $\alpha$ is an integer. By storing the binary digits $a_1$, $a_2$, and $a_3$ is a counter and storing $\alpha$ expressed in binary form in a counter, then counting down the first counter and counting down the second counter each time the first counter goes through 0, a series of numbers can be generated which approximate an exponential relationship. If the numbers are complemented, a series of numbers is generated which increases exponentially. The counting rate then controls how fast or how slowly the slope of the exponential curve changes.

Using this principle, the present invention provides an ADSR generator which comprises first and second binary counters. Means including a variable clock source counts the first counter down and the second counter is counted down by underflow pulses generated by the first counter when it counts down through 0. Contents of the first counter are converted to a fixed point number by shift means which receives the binary contents of the first counter and shifts the binary contents a number of places determined by the count condition of the second counter to convert the floating point number to a fixed point number. Associated controls initiate the counting of the counters from the clock source when a note is initiated by depressing a key. Separate controls convert from an attack to a decay by terminating a 2's complement of the fixed point numbers after a predetermined attack time period. The sustain period is initiated by interrupting the counters during the decay and continuing the counter after the key is released.

DESCRIPTION OF THE DRAWINGS

For a more complete understanding of the invention, reference should be made to the accompanying drawings wherein.

DETAILED DESCRIPTION

Figure 1:
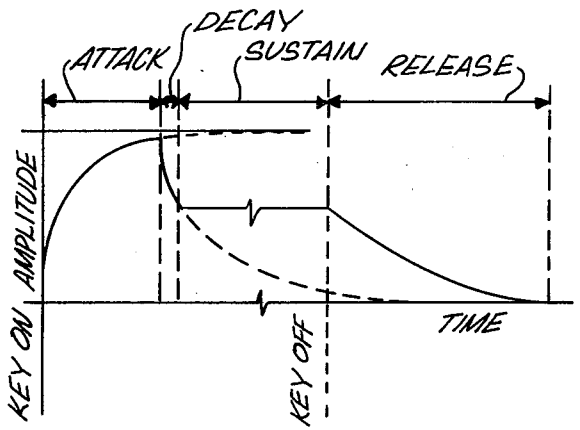
FIG. 1 is a graphical plot of the envelope waveform produced by the ADSR generator of the present invention.

Referring to FIG. 1, there is shown a diagram of the envelope waveform of the ADSR generator of the present invention. During the initial attack phase, the amplitude rises abruptly and levels off exponentially. During the following decay phase, the amplitude drops off exponentially to an intermediate level at which it remains during the sustain phase. The length of time of the sustain phase is determined by the time the key on the keyboard is held down. When the key is released, the amplitude continues to decrease exponentially. The waveform can be modified as hereinafter described, to shorten the attack time and to eliminate the sustain, in a manner characteristic of percussion sounds. These variations are achieved by combining two basic waveforms; a rising exponential curve and a declining exponential curve.

Figure 2:
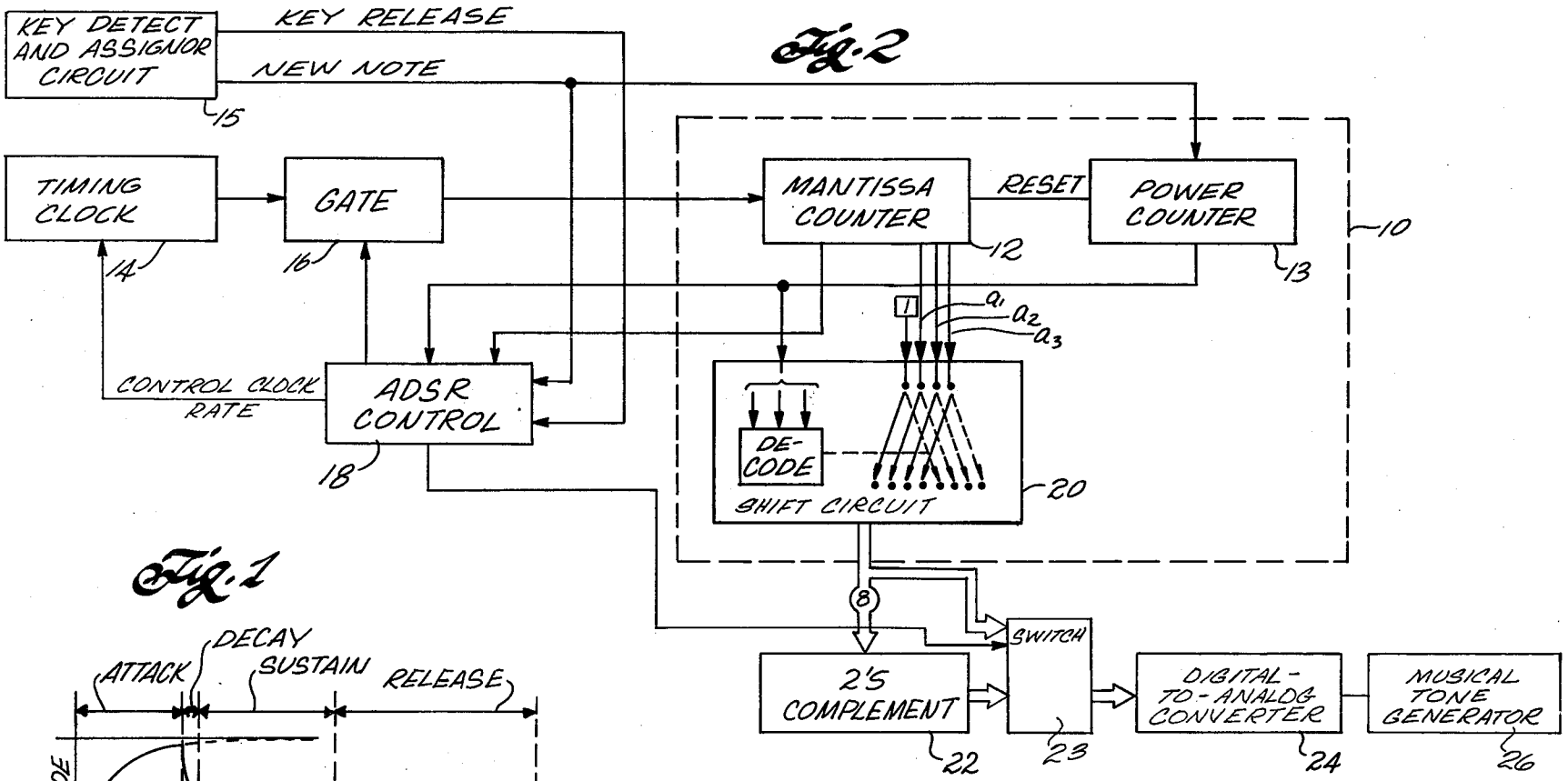
FIG. 2 is a block diagram of the ADSR generator of the present invention.

By the present invention, the exponential curves are generated digitally in the manner shown in FIG. 2 where the exponential curve generator is indicated generally at 10. The curve generator includes a first binary counter 12, the mantissa counter, which preferably has three binary stages (modulo 8). A second binary counter 12, the power counter, can be counted down by clock pulses from a timing source 14. The counter 13 stores three more binary bits. The second counter 13 is counted down by underflow pulses from the highest order state of the first counter 12. The three stages of the first counter store the mantissa and the three stages of the second counter store the power of a floating point number. The three bits of the mantissa correspond to the binary bits $a_1$, $a_2$, and $a_3$, and the three power bits correspond to the value $\alpha$ in the binary floating point number expressed above in the form $1.a_1a_2a_3x2^{\alpha}$. The counter 12 is arranged to count down in response to clock pulses derived from the timing clock source 14 through a gate 16.

When a key is actuated on the keyboard, a signal on line 87 from a key detect and assignor circuit 15, described in detail in U.S. Pat. No. 4,022,098, entitled "Keyboard Switch Detect and Assignor Circuit", and hereby incorporated by reference, indicates that a new note is being generated by the tone generator. This sets the counter 12 to binary 1's in all three stages while the counter 13 is set to binary 1 in the highest order stage and to binary 0 in the other two stages. The new note signal is also applied to an ADSR control circuit 18, which in response to the new note signal opens the gate 16 thereby initiating the counting down of the counter 12 by pulses from the timing clock 14.

The three binary digits $a_1$, $a_2$, and $a_3$ stored in the counter 12 are applied to a parallel shift circuit 20. A fourth most significant digit, always being a binary 1, is applied by wired logic to a fourth input line to the parallel shift circuit 20. Parallel shift circuit 20 also receives and decodes the output of the power value $\alpha$ of the counter 13. Parallel shift circuit 20 has eight output lines. Parallel shift circuit 20 operates as a five position switch, the five positions corresponding to five different binary coded states of the power $\alpha$ of the counter 13. The parallel shift circuit 20 shifts the four input lines relative to the eight output lines by switching to any one of five positions determined by the contents of counter 13. Each time the counter 13 counts down one, the input lines are switched one position to the right. All output lines not connected to an input line provide an output signal corresponding to binary 0. The effect of the parallel shift circuit 20 is to convert the four bit floating point number to an eight bit fixed point number.

The output from the parallel shift circuit 20 is applied to a 2's complement circuit 22. The 2's complement circuit complements each of the eight binary input bits received from the shift circuit 20 and adds a binary one to the least significant bit. A switch 23, in response to an output signal from the ADSR control 18, selectively connects either the input to or the output from the circuit 22 to envelope utilization means. Thus, the output of the ADSR generator is either the same as the output of the parallel shift circuit 20 or is the 2's complement of the output depending upon the control signal from the ADSR control 18. The binary coded input and output of the 2's complement circuit 22 are shown in the following table, which also shows the decimal equivalents. The RELEASE columns correspond to the 2's complement input and the ATTACK columns correspond to the 2's complement output.

It will be noted that all the numbers in the table are positive numbers, so that the decimal equivalent of the 2's complement is equal to the uncomplemented number subtracted from one, i.e., the sum of the numbers in the decimal columns for each step is one. Thus the 2's complement output when converted to an analog signal produces the inverse of the exponential curve resulting from the uncomplemented output, in conformance with the desired attack, decay, and release curves shown in FIG. 1.

| | RELEASE | | ATTACK | |
|---|---|---|---|---|
| STEP | BINARY | DECIMAL | BINARY | DECIMAL |
| 1 | 11110000 | 0.937500 | 00010000 | 0.062500 |
| 2 | 11100000 | 0.875000 | 00100000 | 0.125000 |
| 3 | 11010000 | 0.812500 | 00110000 | 0.187500 |
| 4 | 11000000 | 0.750000 | 01000000 | 0.250000 |
| 5 | 10110000 | 0.687500 | 01010000 | 0.312500 |
| 6 | 10100000 | 0.625000 | 01100000 | 0.375000 |
| 7 | 10010000 | 0.562500 | 01110000 | 0.437500 |
| 8 | 10000000 | 0.500000 | 10000000 | 0.500000 |
| 9 | 01111000 | 0.468750 | 10001000 | 0.531250 |
| 10 | 01110000 | 0.437500 | 10010000 | 0.562500 |
| 11 | 01101000 | 0.406250 | 10011000 | 0.593750 |
| 12 | 01100000 | 0.375000 | 10100000 | 0.625000 |
| 13 | 01011000 | 0.343750 | 10101000 | 0.656250 |
| 14 | 01010000 | 0.312500 | 10110000 | 0.687500 |
| 15 | 01001000 | 0.281250 | 10111000 | 0.718750 |
| 16 | 01000000 | 0.250000 | 11000000 | 0.750000 |
| 17 | 00111100 | 0.234375 | 11000100 | 0.765625 |
| 18 | 00111000 | 0.218750 | 11001000 | 0.781250 |
| 19 | 00110100 | 0.203125 | 11001100 | 0.796875 |
| 20 | 00110000 | 0.187500 | 11010000 | 0.812500 |
| 21 | 00101100 | 0.171875 | 11010100 | 0.828125 |
| 22 | 00101000 | 0.156250 | 11011000 | 0.843750 |
| 23 | 00100100 | 0.140625 | 11011100 | 0.859375 |
| 24 | 00100000 | 0.125000 | 11100000 | 0.875000 |
| 25 | 00011110 | 0.117188 | 11100010 | 0.882813 |
| 26 | 00011100 | 0.109375 | 11100100 | 0.890625 |
| 27 | 00011010 | 0.101563 | 11100110 | 0.898438 |
| 28 | 00011000 | 0.093750 | 11101000 | 0.906250 |
| 29 | 00010110 | 0.085938 | 11101010 | 0.914063 |
| 30 | 00010100 | 0.078125 | 11101100 | 0.921875 |
| 31 | 00010010 | 0.070313 | 11101110 | 0.929688 |
| 32 | 00010000 | 0.62500 | 11110000 | 0.937500 |
| 33 | 00001111 | 0.058594 | 11110001 | 0.937500 |
| 34 | 00001110 | 0.054688 | 11110010 | 0.945313 |
| 35 | 00001101 | 0.050781 | 11110011 | 0.945313 |
| 36 | 00001100 | 0.046875 | 11110100 | 0.953125 |
| 37 | 00001011 | 0.042969 | 11110101 | 0.953125 |
| 38 | 00001010 | 0.039063 | 11110110 | 0.960938 |
| 39 | 00001001 | 0.035156 | 11110111 | 0.960938 |
| 40 | 00001000 | 0.031250 | 11111000 | 0.968750 |

The output from the switch circuit 23 is applied to a suitable envelope utilization means, such as a digital-to-analog converter 24 to produce an analog signal having either the rising waveform of the attack curve or the falling waveform of the decay and release curves shown in FIG. 1, as determined respectively by the selection by the switch circuit 23 of uncomplemented or complemented values. The analog signal can then be used to modulate the signal generated by a tone generator 26 in response to actuation of the key on the keyboard, all in a manner described in detail in the above-identified patent application.

The ADSR control circuit contains simple logic for sensing when a new note is received on the input line from the key detect and assignor circuit 15. The ADSR control 18 in response to the new note signal opens the gate 16 and at the same time its sets the switch 23 to the output of the 2's complement circuit 22. When the power counter 13 counts down to zero, this is sensed by the ADSR control 18 which in response thereto sets the switch 23 to the output of the SHIFT circuit 20, thereby terminating the attack and initiating the decay portion of the ADSR curve calculation. The ADSR control 18 senses when the power counter 13 counts down 1 after the start of the decay calculation. At this point it closes the gate 16 preventing further countdown of the counters 12 and 13 until the ADSR control 18 senses the key release signal one line 86 from the key detect and assignor circuit 15. The gate 16 is again opened when the key is released and the counters 12 and 13 allowed to count down to zero, at which point the ADSR control 18 again closes the gate 16, completing the cycle of operation.

From the above description it will be apparent that an ADSR generator of relatively simple design is provided yet has considerable flexibility. For example, the counting rate can be varied during each phase in order to alter the relative time duration of the attack, decay and release portions of the envelope curve. The ADSR generator can be time-shared in a polyphonic system as described in copending application Ser. No. 652,217, filed June 26, 1976, entitled "ADSR Envelope Generator". This can be accomplished by using the envelope phase shift register described in the above-identified application to store the status of the ADSR control 18 and using the amplitude shift register described in the above-identified application to store the count condition of the counters 12 and 13 for each of the tones being generated.

What is claimed is:

1. An ADSR generator for providing a modulating signal to a musical tone generator wherein the generator includes means to modulate the envelope of the audio signal produced by the tone generator, the ADSR generator comprising multiple bit binary counter means including a low order section and a high order section, means including a clock source for counting the counter means, shift means receiving the binary contents of the low order section of the counter means, and means shifting the shift means by a number of bits equal to the count of the high order section of the counter means.

2. Apparatus of claim 1 wherein the counter means is set initially to the maximum count condition and is counted down.

3. The apparatus of claim 1 further including complementing means coupled to the output of the shift means for generating the 2's complement of the binary output of the shift means, switch means for selectively connecting either the output of the shift means or the output of the complementing means to the tone generator.

4. The apparatus of claim 3 further including means for selectively varying the clock rate of the clock source.

5. Apparatus of claim 3 further including means for interrupting the counting of the counter means when the counter means counts down to a predetermined count level.

6. In a keyboard-operated electronic organ or the like, apparatus for controlling the amplitude of a musical tone generated by a musical tone generator in response to activating a key, comprising: binary counter means having a plurality of counting stages arranged in a low order section of a high order section, means including a source of clock pulses for initiating counting of the counter means when a key is operated, a plurality of output lines greater than the number of stages in the low order section of the counter means, shift means responsive to the count condition of the high order section of the counter means for connecting the binary stages of the low order sections to selected ones of the output lines for setting a binary value on the output lines corresponding to the binary count condition of the low order section of the counter means, the shift means shifting the outputs of the low order section relative to the output lines with each change in the output of the high order section, the shift means setting the output lines not connected to the low order section to one binary value, and means responsive to the output binary value on the output lines for modulating the musical tone generator.

7. Apparatus of claim 6 further including complementing means coupled to the output of the shift means for generating the 2's complement of the binary output of the shift means, switch means for selectively connecting either the output of the shift means or the output of the complementing means to the tone generator.

8. Apparatus of claim 7 wherein the counter means is set initially to the maximum count condition and is counted down.

9. Apparatus of claim 7 further including means for interrupting the counting of the counter means at a predetermined count condition, and means restarting the counting means when the activated key on the keyboard is released.

10. Apparatus of claim 7 wherein the means for modulating the tone generator includes a digital-to-analog converter, said switch means selectively connecting either the output of the shift means or the complementing means to the converter.

* * * * *